US011325166B2

(12) United States Patent
Kane et al.

(10) Patent No.: US 11,325,166 B2
(45) Date of Patent: May 10, 2022

(54) APPARATUS FOR AXIAL DISENTANGLEMENT OF DEBRIS FROM A MECHANICAL AGITATOR

(71) Applicant: International Business Machines Corporation, Armonk, NY (US)

(72) Inventors: Michael Kane, Hopewell Junction, NY (US); Suraush Khambati, Poughkeepsie, NY (US); Jacob Porter, Highland, NY (US); Colin Edward Masterson, Rochester, MN (US); Marie Cole, Wappingers Falls, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 392 days.

(21) Appl. No.: 16/587,327

(22) Filed: Sep. 30, 2019

(65) Prior Publication Data

US 2021/0094077 A1 Apr. 1, 2021

(51) Int. Cl.

| | |
|---|---|
| ***A47L 9/04*** | (2006.01) |
| ***A46B 17/06*** | (2006.01) |
| ***A47L 5/30*** | (2006.01) |
| ***B08B 1/00*** | (2006.01) |

(52) U.S. Cl.

CPC ..... *B08B 1/007* (2013.01); *A46B 17/06* (2013.01); *A47L 5/30* (2013.01); *A47L 9/0477* (2013.01)

(58) Field of Classification Search

CPC ..... A46B 17/06; A47L 5/30; A47L 9/0466; A47L 9/0477; B08B 1/007

See application file for complete search history.

(56) References Cited

U.S. PATENT DOCUMENTS

| | | | | |
|---|---|---|---|---|
| 2,564,721 A | | 8/1951 | Raya | |
| 4,084,282 A | * | 4/1978 | Calvert | A46B 17/06 15/23 |
| 4,173,807 A | | 11/1979 | Maier | |
| 4,225,997 A | * | 10/1980 | Thomas | A46B 7/023 15/184 |
| 5,482,562 A | | 1/1996 | Abernathy | |

(Continued)

OTHER PUBLICATIONS

Taper Angle. ScienceDirect. Various Titles: Retrieved from: https://www.sciencedirect.com/topics/engineering/taper-angle; 2018 (16 pages).

*Primary Examiner* — Randall E Chin

(74) *Attorney, Agent, or Firm* — Cantor Colburn LLP; Tihon Poltavets

(57) ABSTRACT

Devices and processes for axial disentanglement of debris from a rotatable mechanical agitator generally includes a cleaning member including a top stem portion, an intermediate cutting portion, and a bottom base portion; and a cylindrically-shaped mechanical agitator rotatably mounted within a head unit. The mechanical agitator includes one or more channels extending along a longitudinal axis and the head unit includes a slot opening coaxially aligned with a channel when in use. The bottom base portion and the intermediate cutting portion are configured to traverse a length of the one or more channels, wherein the intermediate cutting portion is positioned to cut debris entangled on the mechanical agitator when the top stem portion slidingly engages the slot opening in the head unit.

8 Claims, 4 Drawing Sheets

(56) References Cited

U.S. PATENT DOCUMENTS

| | | | | |
|---|---|---|---|---|
| 6,408,475 | B1 | 6/2002 | Morrison | |
| 6,539,575 | B1 * | 4/2003 | Cohen | A46B 13/001 15/364 |
| 6,779,220 | B1 | 8/2004 | Raffa | |
| 6,810,559 | B2 * | 11/2004 | Mertes | A47L 9/0455 15/179 |
| 9,314,140 | B2 * | 4/2016 | Eriksson | A47L 9/30 |
| 10,136,786 | B2 | 11/2018 | Deng et al. | |
| 2014/0053362 | A1 | 2/2014 | Hosterman | |
| 2017/0127907 | A1 | 5/2017 | Sommerfelt et al. | |
| 2020/0196813 | A1 * | 6/2020 | Li | A47L 7/0066 |

* cited by examiner

APPARATUS FOR AXIAL DISENTANGLEMENT OF DEBRIS FROM A MECHANICAL AGITATOR

BACKGROUND

The present invention generally relates to an apparatus for axial disentanglement of debris from a mechanical agitator.

Cleaning devices typically utilize mechanical agitators to clean various surfaces (e.g., factory floors) and these mechanical agitators can function in a variety of ways and appear in many forms. A typical mechanical agitator is a cylindrical tube that rotates about its longitudinal axis and has one or more features that agitate a surface as it rotates. Such features typically include one or more bristle tufts, flexible flaps, bumps, and so on. This type of mechanical agitator moves or dislodges dirt from the surface, making it easier to collect by the cleaning device. Rotatable mechanical agitators are useful in a variety of cleaning devices including vacuum cleaners, sweepers, wet extractors, and so on. In a sweeper, the agitator typically moves or throws the dirt directly into a receptacle. In a vacuum cleaner or similar device, the dirt may be entrained in an airflow generated by a vacuum within the cleaning device and thereby conveyed to a filter bag, cyclone separator or other kind of dirt collection device in the vacuum cleaner.

SUMMARY

Embodiments of the present invention are generally directed to a devices and methods for disentangling fibers captured on a rotating mechanical agitator. In one or more embodiments, a non-limiting example of a device includes a head unit including a top wall, a bottom wall, and sidewalls extending from the bottom wall to the top wall, wherein the head unit includes a slot opening. A cleaning member including a top stem portion, an intermediate cutting portion, and a bottom base portion, wherein the top stem portion of the cleaning member is configured to slidingly engage the slot opening when in use. A cylindrically-shaped mechanical agitator is rotatably mounted within the head unit and coaxially aligned with the slot opening in the head unit. The mechanical agitator includes one or more channels extending along a longitudinal axis of the mechanical agitator, wherein each of the one or more channels includes a bottom surface and sidewalls extending from the bottom surface to an outermost surface of the mechanical agitator. The slot opening in the head unit is coaxially aligned with the one or more channels, wherein the bottom base portion and the intermediate cutting portion of the cleaning member are configured to traverse a length of the one or more channels. The intermediate cutting portion is positioned to cut debris entangled on the mechanical agitator when the top stem portion slidingly engages the slot opening in the head unit.

In one or more embodiments, a device includes a head unit comprising a top wall, a bottom wall, and sidewalls extending from the bottom wall to the top wall, wherein the head unit comprises a slot opening. A cleaning member including a top stem portion is coupled to an arcuate portion including two or more intermediate cutting and bottom base portions extending from the arcuate portion. The bottom base portion is coupled to the intermediate cutting portion, wherein the two or more intermediate cutting and bottom base portions are spaced apart about the arcuate portion. The stem top portion is configured to slidingly engage the slot opening when in use. A cylindrically-shaped mechanical agitator is rotatably mounted within the head unit and coaxially aligned with the slot opening in the head unit. The mechanical agitator includes multiple channels spaced about and extending along a longitudinal axis of the mechanical agitator, wherein each of the multiple channels comprises a bottom surface and sidewalls extending from the bottom surface to an outermost surface of the mechanical agitator. The slot opening in the head unit is coaxially aligned with a selected one of the multiple channels, wherein the two or more intermediate cutting and bottom base portions are configured to simultaneously traverse a length of a different one of the multiple channels. The intermediate cutting portion is positioned to cut debris entangled on the mechanical agitator when the stem top portion slidingly engages the slot opening in the head unit.

In one or more embodiments, a non-limiting example of the process for disentanglement of debris from a mechanical agitator rotatably mounted within a head unit includes providing a slot opening in the head unit coaxially aligned with an axis of rotation of the mechanical agitator. The mechanical agitator includes one or more channels extending along a longitudinal axis of the mechanical agitator, wherein each of the one or more channels comprises a bottom surface and sidewalls extending from the bottom surface to an outermost surface of the mechanical agitator. A cleaning member is slidably engaged with the slot opening provided in the head unit, wherein the cleaning member includes a top stem portion, an intermediate cutting portion, and a bottom base portion. Slidably engaging the cleaning member with the slot opening engages and traverses the bottom base portion along a length of a selected one of the one or more channels, wherein the intermediate cutting portion is positioned to cut debris entangled on the mechanical agitator.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

Figure 1:
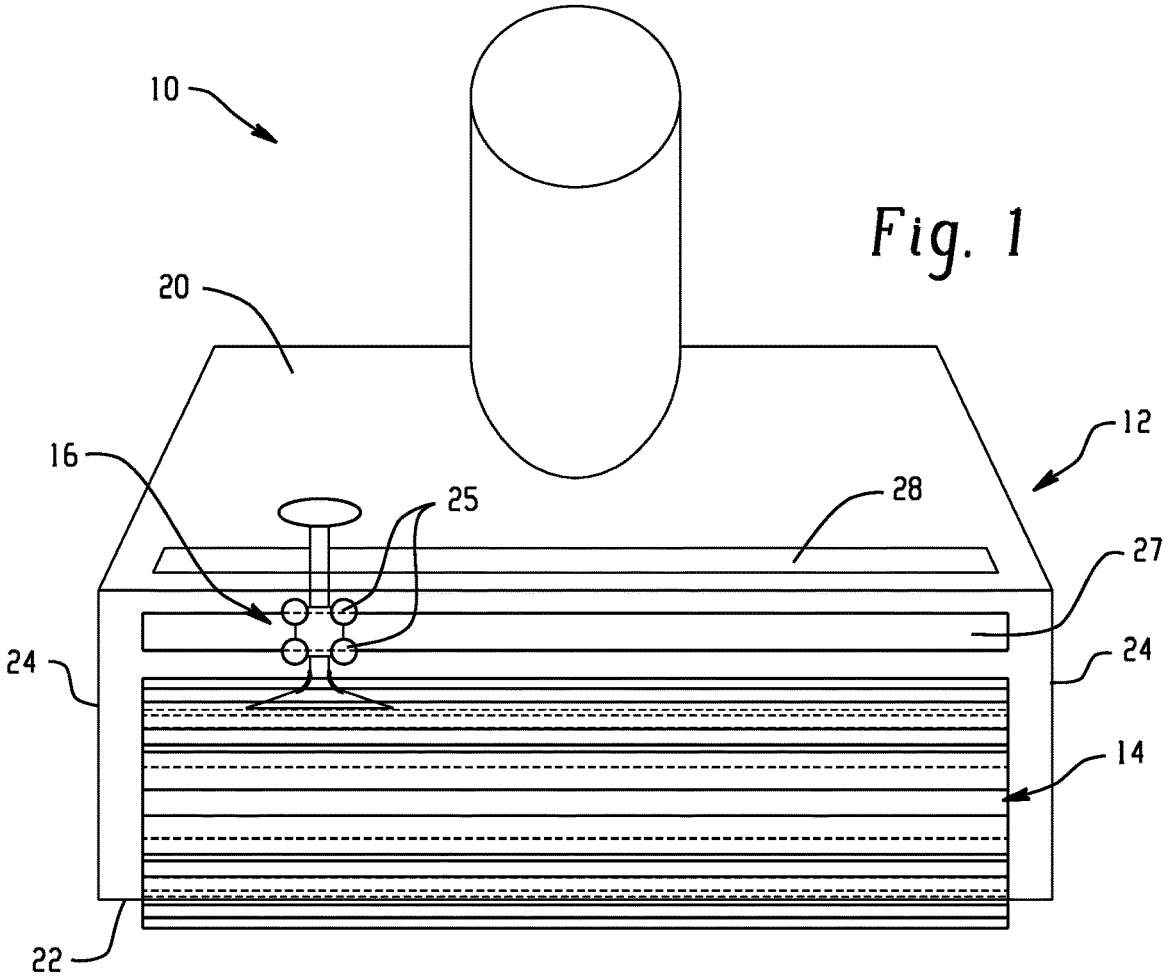
FIG. 1 illustrate a front perspective view of a portion of a device including a head unit in accordance with one or more embodiments of the present invention.

The drawings are not necessarily to scale. The drawings, some of which are merely pictorial and schematic representations, are not intended to portray specific parameters of the invention. The drawings are intended to depict only typical embodiments of the invention, and therefore should not be considered as limiting. In the drawings, like numbering represents like elements.

DETAILED DESCRIPTION

Various types of devices include rotating mechanical agitators such as vacuum cleaners, floor sweepers, hay balers, brush hogs, bush whackers, hay rolling machines and the like that can collect a significant amount of various kinds of dirt and debris on the mechanical agitator itself. For example, depending on the application of the device-type, the debris can include wires, strings, threads, fibers, other elongated objects that wrap around or otherwise cling to the agitator, or various combinations thereof. It has also been found that accumulated debris can reduce the performance of the mechanical agitator in a variety of ways. For example, debris may cover the agitation bristles and diminish the agitator's ability to agitate a surface. Further, debris on the mechanical agitator can impede the rotation of the mechanical agitator by wrapping around the axle or by creating additional friction with the head unit. If not removed, such debris can also accumulate on or migrate to the ends of the agitator and enter the bearing areas where they may cause binding, remove bearing lubrication, or otherwise generate high friction, excessive heat, or other undesirable conditions that can damage the bearings or mounting structure. In addition, debris collected on the agitator may create an imbalance in the agitator that may result in sound and/or vibrations when the agitator rotates.

Debris that has collected on a mechanical agitator is often difficult to remove because it has wrapped tightly around the agitator and intertwined with the bristles. Users of such a device often must invert the device and remove the debris with manual tools such as knives, scissors or other implements. Manual removal can be unsanitary, time consuming and, if the user fails to follow instructions to deactivate the device, may expose the user to contact with a moving agitator.

The present invention overcomes the problems associated with mechanical agitator devices prone to debris entanglement without disassembly or additional tools. The devices incorporate a cleaning member in the head unit that is designed to traverse along the longitudinal axis of the mechanical agitator when the agitator is not rotating. The mechanical agitator features axial channels therein that allow sliding engagement of the cleaning member along its longitudinal axis, which can be configured to disentangle debris captured on the agitator. In one or more embodiments, the cleaning member includes a cutting portion positioned to cut where the debris is typically situated for a given device, e.g., at, below, and/or above an outermost surface of the mechanical agitator. Optionally, the mechanical agitator can include a self-aligned channel portion to automatically align the cleaning member with the axially oriented channels. Advantageously, user safety is improved as disentanglement of the debris does not require disassembly, lifting, or application of external cutting tools. Moreover, the present invention provides the user with improved flexibility with regard to implementing the cleaning member, which generally can be done at any time. Still further, the cutting portion can be completely contained within the head unit of the device.

Although reference herein will be made specifically to vacuum cleaner such as upright vacuums, canister vacuums, central vacuum systems for ease in understanding the invention, embodiments of the invention as utilized in vacuum devices may also be integrated for use in with any type of device including an agitator having a propensity to collect debris such as powder or fluid extractors, or sweepers, hay balers, brush hogs, bush whackers, hay rolling machines and the like.

The terminology used herein is for the purpose of describing particular embodiments of the present invention only and is not intended to be limiting. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. It will be further understood that the terms "comprises" and/or "comprising", or "includes" and/or "including", when used in this specification, specify the presence of stated features, regions, integers, steps, operations, elements, and/or components, but do not preclude the presence or addition of one or more other features, regions, integers, steps, operations, elements, components, and/or groups thereof.

As used herein, the terms "invention" or "present invention" are non-limiting terms and not intended to refer to any single aspect of the particular invention but encompass all possible aspects as described in the specification and the claims.

As used herein, the terms "about," "substantially," and equivalents thereof modifying the quantity of an ingredient, component, or reactant of the invention employed, or modifying any other quantity or dimension, refers to variation in the numerical quantity that can occur, for example, through typical measuring and liquid handling procedures used for making concentrates or solutions. Furthermore, variation can occur from inadvertent error in measuring procedures, differences in the manufacture, source, or purity of the ingredients employed to make the compositions or carry out the methods, and the like. In one aspect, the term "about" means within 10% of the reported numerical value. In another aspect, the term "about" means within 5% of the reported numerical value. Yet, in another aspect, the term "about" means within 10, 9, 8, 7, 6, 5, 4, 3, 2, or 1% of the reported numerical value.

In addition, it will be understood that when an element as a layer, region, or substrate is referred to as being "on" or "over", or "disposed on" another element, it can be directly on the other element or intervening elements can also be present. In contrast, when an element is referred to as being "directly on", "directly over", or "disposed proximately to" another element, there are no intervening elements present. It will also be understood that when an element is referred to as being "connected" or "coupled" to another element, it can be directly connected or directly coupled to the other element, or intervening elements can be present. In contrast, when an element is referred to as being "directly connected" or "directly coupled" to another element, there are no intervening elements present.

Spatially relative terms, e.g., "beneath," "below," "lower," "above," "upper," and the like, can be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device can be otherwise oriented (rotated 90 degrees or at other orientations) and the spatially relative descriptors used herein interpreted accordingly.

Various embodiments of the present invention will now be described with reference to the related drawings. Alternate embodiments of the present invention can be devised without departing from the scope of the invention. Various connections might be set forth between elements in the following description and in the drawings. These connections, unless specified otherwise, can be direct or indirect, and the present description is not intended to be limiting in this respect. Accordingly, a coupling of entities can refer to either a direct or an indirect connection.

Figure 2:
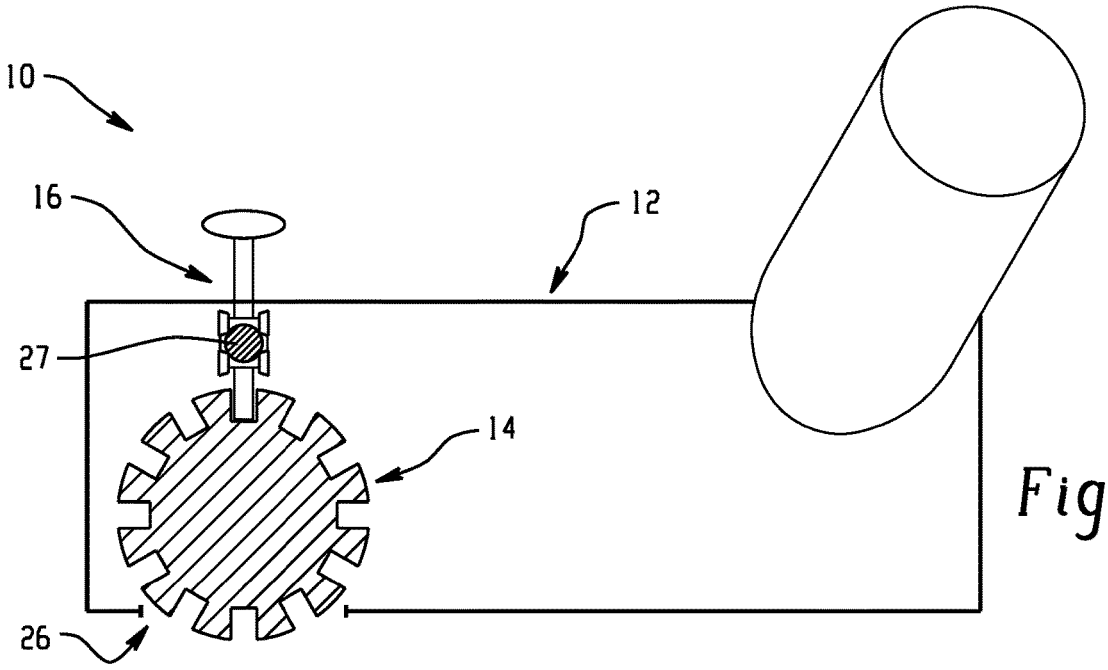
FIG. 2 is a side elevational view of the device depicted in FIG. 1 in accordance with one or more embodiments of the present invention.

Turing now to FIGS. 1 and 2, there is depicted a portion of a device 10 including a head unit 12 including a rotatable mechanical agitator 14 and a debris cleaning member 16 mounted therein. As noted above, the portion of the device 10 is not intended to be limited to any specific type of device and can be integrated for use in vacuum cleaners, floor sweepers, hay balers, brush hogs, bush whackers, hay rolling machines, powder or fluid extractors, sweepers, or the like.

The head unit 12 generally includes a top portion 20, a bottom portion 22 and sidewalls 24 extending from the bottom portion 22 to the top portion 20. In one or more embodiments, the bottom portion 22 includes an opening 26 configured to permit contact of the agitator 14 with a surface (not shown), which will generally depend on the type of device 10. For example, in the case of vacuum cleaners, the surface is typically a floor whereas for a hay baler, the surface is typically the ground, i.e., the solid surface of the earth. The top portion 20 can include a slot opening 28, wherein the debris cleaning member 16 is configured to slidingly engage the slot opening 28. The slot opening 28 is coaxially aligned with a channel 30 (see FIG. 3) provided in the agitator 14, which will be described in greater detail below. Optionally, the slot opening can be provided in a front sidewall of the head unit 12 and is coaxially aligned with the channel 30.

The cleaning member 16 of the head unit 12 includes rollers 25 attached thereto that are configured to engage a bar 27 extending laterally from the opposing sides 24. During use, the cleaning member 16 can be moved along the slot opening 28 using the rollers 25 at a constant height relative to the mechanical agitator 14. The bar 27 is coaxially aligned with the slot opening 28.

The head unit 12 can include additional features depending on the device configuration for a given application. For example, in one or more embodiments, the head unit 12 can be configured as a floor sweeper or a vacuum cleaner. Such head units are known in the art, and may include additional features such as a motor to rotatably drive the mechanical agitator 14 by a belt or gears or other known mechanisms, a dirt receptacle, wheels to support the head unit 12 at a fixed or variable height above the floor, one or more air passages that lead to a vacuum source, and so on. The motor may drive a vacuum fan or impeller, or it may be dedicated to driving only the agitator 14.

Figure 3:
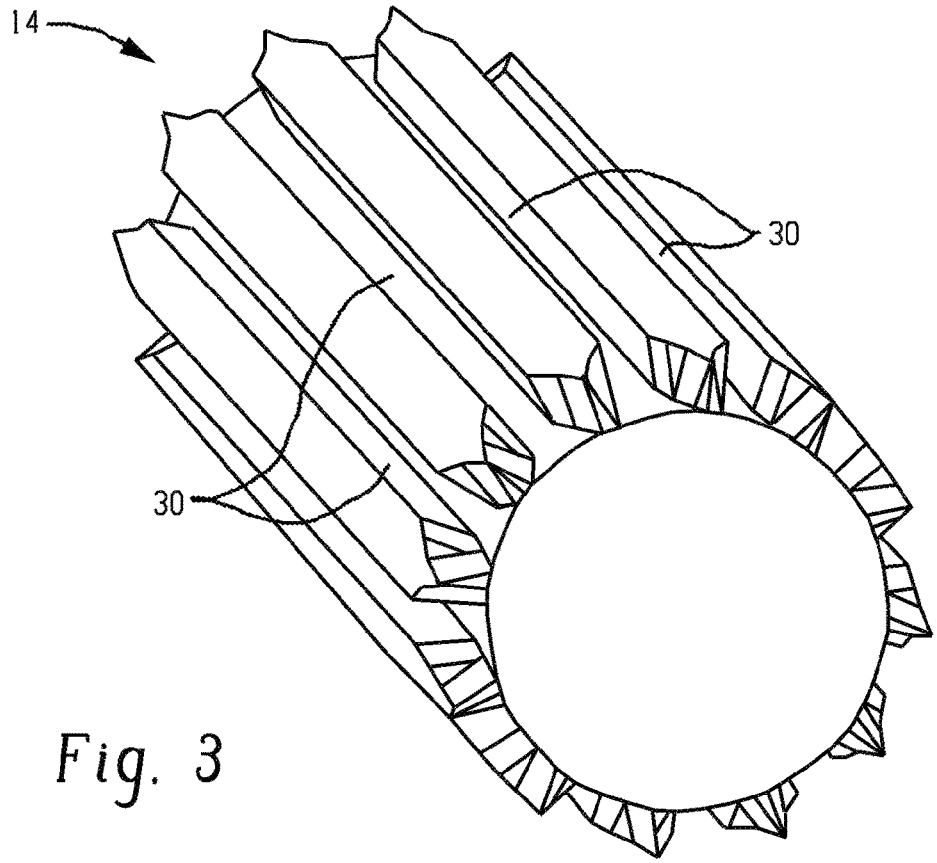
FIG. 3 is a perspective view of a mechanical agitator in accordance with one or more embodiments of the present invention.
Figure 4:
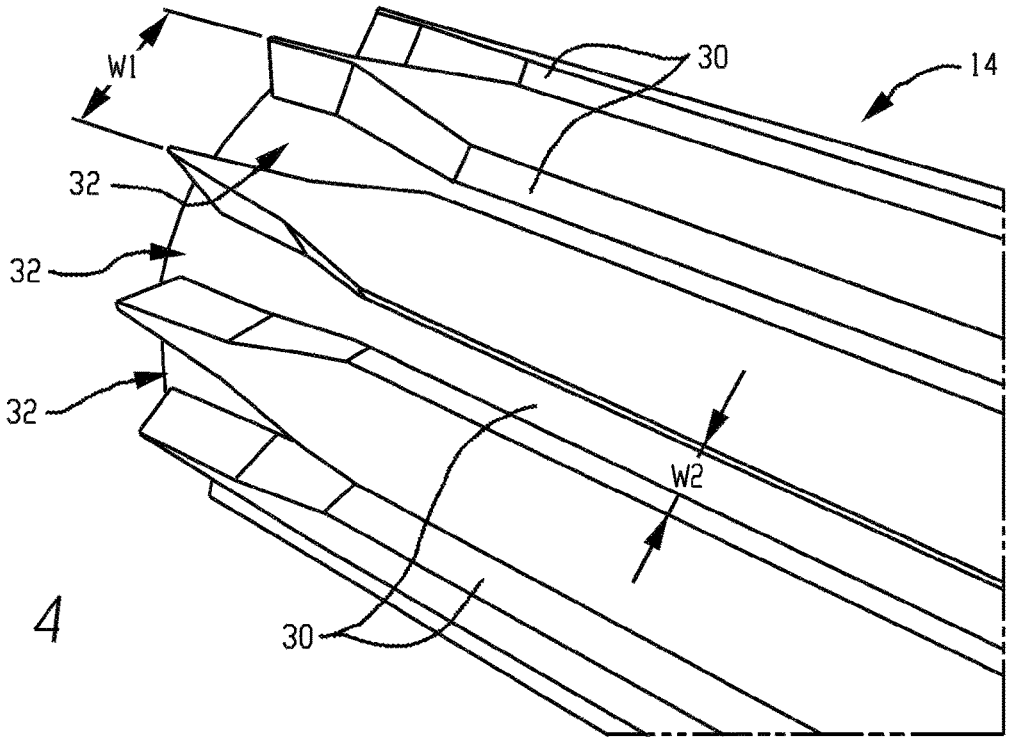
FIG. 4 is a partial perspective view of a mechanical agitator including alignment slots in accordance with one or more embodiments of the present invention.
Figure 5:
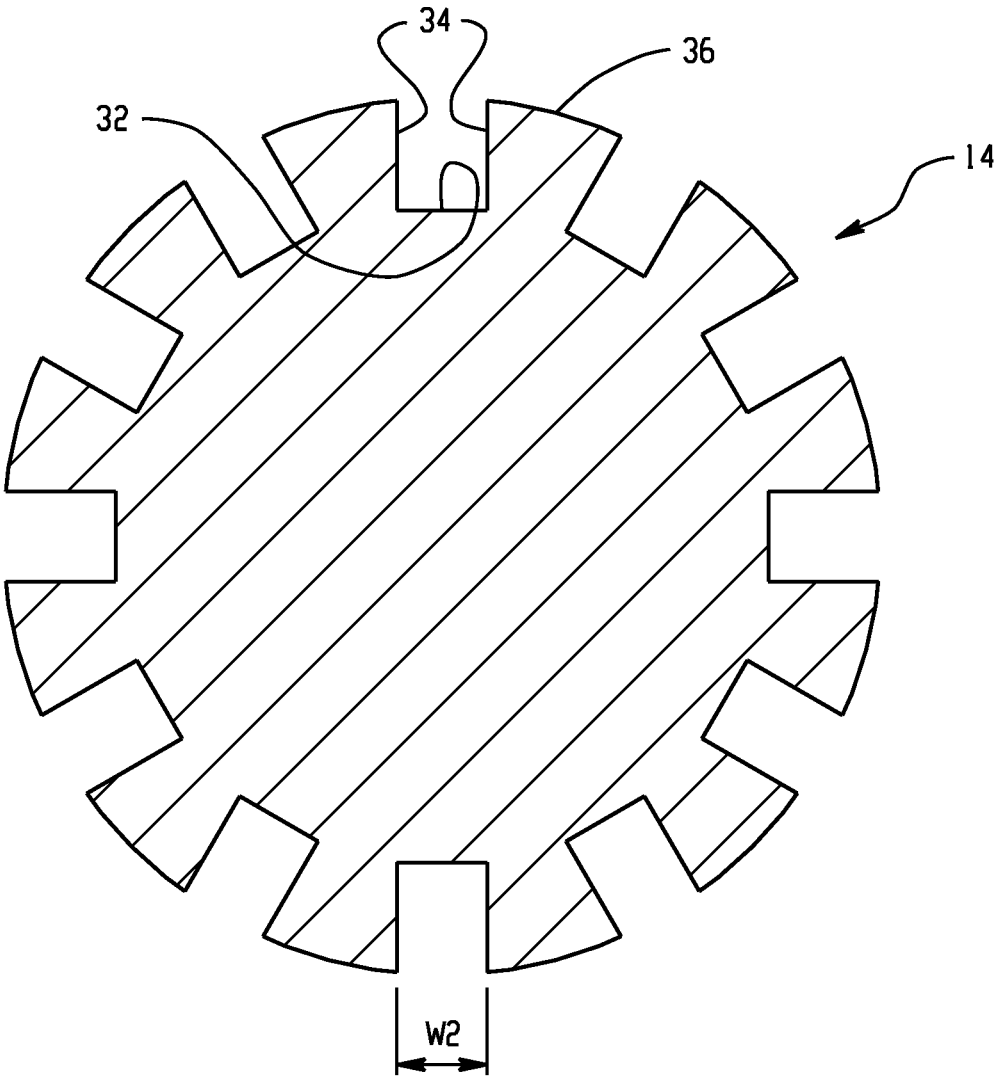
FIG. 5 is a cross sectional view of a mechanical agitator is a perspective view of a mechanical agitator in accordance with one or more embodiments of the present invention.

Referring now to FIGS. 3-5, there are shown perspective views of the mechanical agitator 14 in accordance with one or more embodiments of the present invention. The mechanical agitator 14 is cylindrically shaped and as discussed above is rotatably mounted within the head unit 12. The mechanical agitator 14 includes one or more channels 30 extending along a length of the longitudinal axis of the mechanical agitator 14. The channel(s) 30 can generally be defined as a trench defined by a bottom surface 32 and sidewalls 34 extending from the bottom surface 32 to a top surface 36, which is the outermost surface of the mechanical agitator 14. The top surface 36 can have attached thereto bristle tufts, flexible flaps, bumps, or the like depending on the type of device, which can be in any pattern.

In one or more embodiments, the channel sidewalls 34 are perpendicular to the channel bottom surface 32. Optionally, the channel sidewalls 34 can be configured to converge to retain the cleaning member 16 when slidingly engaged within the channel 30, wherein a width at a bottom of the channel is greater than a width at a top of the channel. In one or more alternative embodiments, the channel sidewalls 34 include a shoulder portion (not shown) to retain the cleaning member 16 when slidingly engaged within the channel 30.

Optionally, one or more self-alignment slots 38 can be provided at one or both terminal ends 40, 42 of the channel(s) 30, wherein the self-alignment slots 32 have a depth about equal to a channel depth and an alignment slot width (W1) greater than a channel width (W2). The alignment slot width (W1) has a tapered profile such that the width (W1) tapers to width (W2) of the channel 30.

Figure 6:
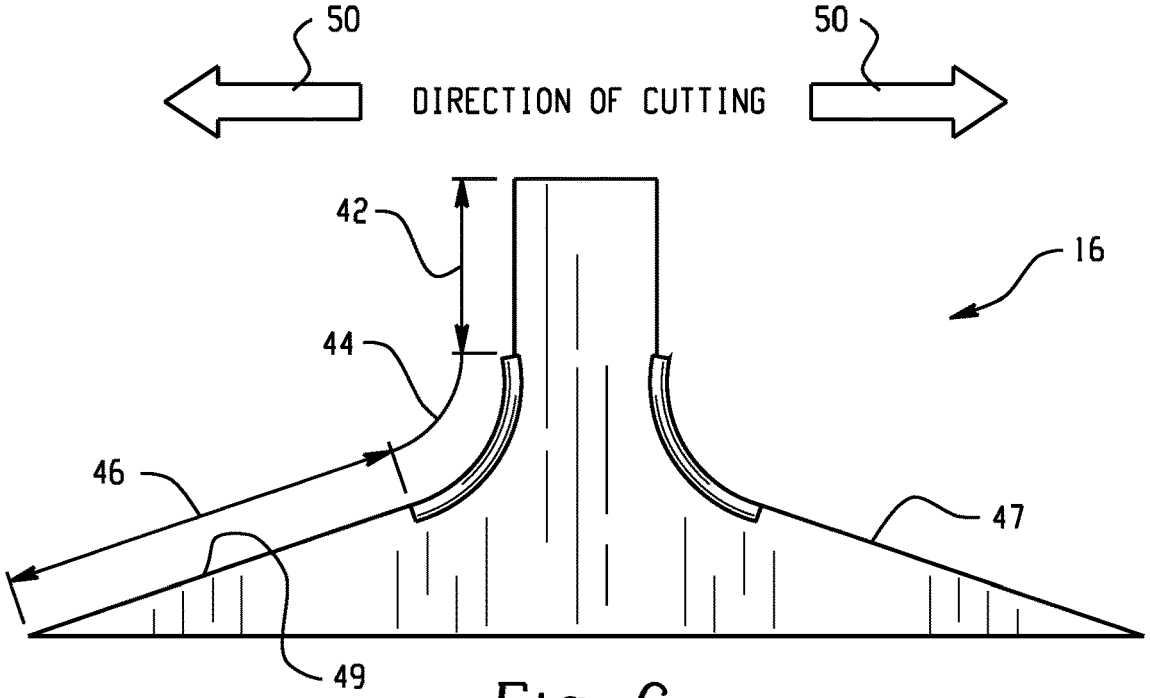
FIG. 6 is a side elevational view of a cleaning member is a perspective view of a mechanical agitator in accordance with one or more embodiments of the present invention.

Turning now to FIG. 6, there is shown a side elevational view of the debris cleaning member 16. The cleaning member 16 generally includes a top stem portion 42, an intermediate cutting portion 44, and a bottom base portion 46.

The top stem portion 42 is configured to slideably engage the slot opening 28 in the head unit 12. More specifically, the stem portion 42 has a width that is less than a width of the coaxially aligned slot opening 28 in the head unit 12 and less than the alignment slot width (W1) and the channel width (W2) such that the cleaning member 16 can traverse the length of the slot opening 28 and the channel 30 when the cleaning member is engaged therewith.

The intermediate cutting portion 44 and the bottom base portion 46 are contained within the head unit 12 and configured to slideably engage and traverse the channel 30 in a selected direction 50 upon movement of the stem portion 42 within the slot opening 28. The cleaning member 16 is configured such that the intermediate cutting portion 44 is at less than, about and/or above a plane defined by the outermost surface 36 of the mechanical agitator 14. In this manner, movement of the cleaning member 16 along the length of the slot opening 28 and the channel 30 can effectively cut any debris entangled about the mechanical agitator.

The intermediate cutting portion 44 includes a cutting surface, e.g., a blade, in one or both cutting directions 50. The cutting surface can be angled or curvilinear relative to the channel such that contact with debris causes the debris to upwardly slide along the cutting surface until the debris is cut. The angle is less than 90 degrees relative to a bottom surface of the channel.

The bottom base portion 46 includes first and second elongate portions 47, 49 extending in both of the cutting directions 50, wherein the first and second elongate portions have a tapered profile as shown. The bottom base portion 46 is configured to be retained within the channel 30 when slidingly engaged therewith.

The one or more self-alignment slots 38 in the mechanical agitator provide self-alignment of the cleaning member 16 with a selected one of the channels 30 (if the mechanical agitator is configured with multiple channels) to slidably engage the cleaning member within the selected channel when the mechanical agitator is not rotating. The self-alignment slots 38 permits disengagement from the channel 30 when the mechanical agitator 14 is rotating such that the cleaning member 16 can be positioned to be free of contact from rotating portions of the mechanical agitator 14. As such, the cleaning member 16 can be positioned and spaced apart the mechanical agitator 14 when disengaged from the selected channel 30 and the mechanical agitator is engaged, i.e., rotating.

Figure 7:
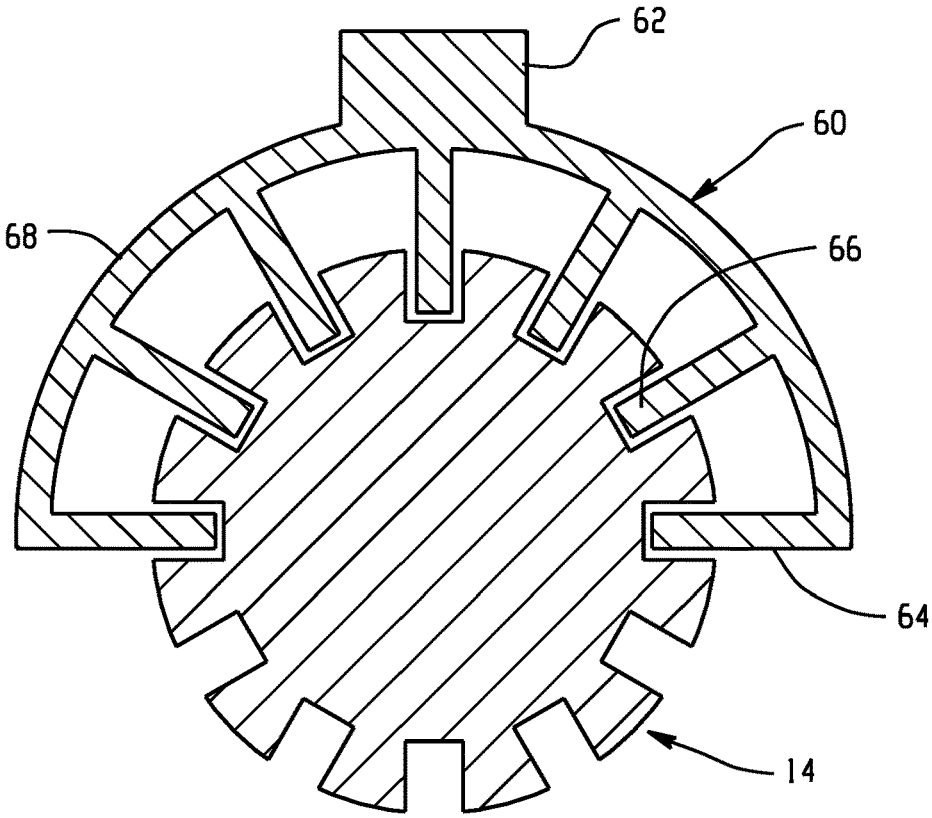
FIG. 7 is a cross sectional view of a cleaning member in accordance with one or more embodiments of the present invention.

Optionally, the device can include cleaning member 60, which can be configured to slidingly engage multiple channels 30 in the mechanical agitator 14 when in use as shown in FIG. 7. The number of channels is not intended to be limited. Cleaning member 60 includes a top stem portion 62, an intermediate cutting portion 64, and a bottom base portion 66 as previously described. The top stem portion 62 extends from and is coupled to an arcuate shaped portion 68 from which the intermediate cutting portion 64, and the bottom base portion 66 extend therefrom. The arcuate shaped portion 68 is concentric disposed about a portion of the mechanical agitator 14. The top stem portion 62 is configured to slidingly engage the slot opening 28 in the head unit 12 such that movement of the top stem portion 62 by an end user causes the bottom base portion 66 to slidingly engage and traverse a length of the channel 30, wherein the intermediate cutting portion 64 is configured to cut debris entangled on the mechanical agitator 14.

In operation, an end user turns off the device 10 and/or disengages rotation of the mechanical agitator 14 and locates the cleaning member 16. The end user then engages the base portion 46 of the cleaning member 16 with a selected one of the self-alignment slots 38 in the mechanical agitator 14 and slides the cleaning member 16 into the channel 30 corresponding to the particular alignment slot 38. The cutting portion 44 of the cleaning member contacts any debris within the sliding direction and effectively cuts the debris wrapped about the mechanical agitator. The end user can rotate the mechanical agitator to align the cleaning member with a different alignment slot 38 and repeat the cutting process. The device can be turned on and/or the mechanical agitator engaged to effect rotation and free the "cut" debris from the mechanical agitator.

The corresponding structures, materials, acts, and equivalents of all means or step plus function elements in the claims below are intended to include any structure, material, or act for performing the function in combination with other claimed elements as specifically claimed. The description has been presented for purposes of illustration and description and is not intended to be exhaustive or limited to the form described. Many modifications and variations will be apparent to those of ordinary skill in the art without departing from the scope and spirit. The embodiments of the present invention described herein were chosen and described in order to best explain the principles of embodiments of the invention and the practical application, and to enable others of ordinary skill in the art to understand the various embodiments of the present invention with various modifications as are suited to the particular use contemplated.

What is claimed is:

1. A device comprising:

a head unit comprising a top wall, a bottom wall, and sidewalls extending from the bottom wall to the top wall, wherein the head unit comprises a slot opening;

a cleaning member comprising a top stem portion coupled to an arcuate portion including two or more intermediate cutting and bottom base portions extending from the arcuate portion, wherein the bottom base portion is coupled to the intermediate cutting portion and the two or more intermediate cutting and bottom base portions are spaced apart, and wherein the top stem portion is configured to slidingly engage the slot opening when in use; and a cylindrically-shaped mechanical agitator rotatably mounted within the head unit and coaxially aligned with the slot opening in the head unit, the mechanical agitator comprising multiple channels spaced about the arcuate portion and extending along a longitudinal axis of the mechanical agitator, wherein each of the multiple channels comprises a bottom surface and sidewalls extending from the bottom surface to an outermost surface of the mechanical agitator, wherein the slot opening in the head unit is coaxially aligned with a selected one of the multiple channels, wherein the two or more intermediate cutting and bottom base portions are configured to simultaneously traverse a length of a different one of the multiple channels, wherein the intermediate cutting portion is positioned to cut debris entangled on the mechanical agitator when the top stem portion slidingly engages the slot opening in the head unit.

2. The device of claim 1, further comprising an alignment slot at one or both ends of each of the multiple channels, wherein the alignment slot is configured to align the bottom base portion with a selected one of the multiple channels when in use and permit disengagement of the cleaning member from the mechanical agitator when not in use.

3. The device of claim 2, wherein the alignment slot has a tapered profile such that an alignment slot width (W1) tapers to a channel width (W2).

4. The device of claim 1, wherein each of the multiple channels comprises converging sidewalls configured to retain the cleaning member within the channel when in use, wherein a width at a bottom of the channel is greater than a width at a top of the channel.

5. The device of claim 1, wherein each of the multiple channels comprises a shoulder portion configured to retain the cleaning member within the channel when in use.

6. The device of claim 1 further comprising a bar within the head unit and coaxially aligned with the slot opening, wherein the bar is positioned intermediate the slot opening and the mechanical agitator, and wherein cleaning member further comprises rollers engaged with the bar.

7. The device of claim 1, wherein the top surface of the mechanical agitator comprises bristle tufts, flexible flaps, or bumps, attached thereto.

8. The device of claim 1, wherein the intermediate cutting portion of the cleaning member is configured to cut debris in each longitudinal direction.

* * * * *